United States Patent [19]

Goto et al.

[11] 4,001,013

[45] Jan. 4, 1977

[54] METHOD OF OPERATING COPPER ORE SMELTING REVERBERATORY FURNACE

[75] Inventors: Motoo Goto; Minoru Fujiwara; Makoto Ishikawa, all of Iwaki, Japan

[73] Assignee: Onahama Seiren Kabushiki Kaisha, Japan

[22] Filed: Sept. 29, 1975

[21] Appl. No.: 617,843

Related U.S. Application Data

[63] Continuation-in-part of Ser. No. 445,335, Feb. 25, 1974, abandoned, which is a continuation-in-part of Ser. No. 264,060, June 19, 1972, abandoned.

[30] Foreign Application Priority Data

July 23, 1971 Japan ..... 46-54656

[52] U.S. Cl. ..... 75/72; 75/74; 75/76; 266/215

[51] Int. Cl.[2] ..... C22B 15/00

[58] Field of Search ..... 75/72, 74, 76, 62, 92; 266/34 L, 34 LM, 34 T, 215

[56] References Cited

UNITED STATES PATENTS

| | | | |
|---|---|---|---|
| 1,940,977 | 12/1933 | Simpson | 75/62 |
| 2,084,830 | 6/1937 | Barnard et al. | 75/74 |
| 3,723,096 | 3/1973 | Parlee et al. | 75/76 |

OTHER PUBLICATIONS

Fryer–Edwards, *Use of an Oxy–Fuel System for Melting and Refining...Copper*, Journ. Inst. Met., 98, Nov. 1970, pp. 332–338.

*Primary Examiner*—Walter R. Satterfield
*Attorney, Agent, or Firm*—Wenderoth, Lind & Ponack

[57] ABSTRACT

A method of operating a reverberatory furnace for copper smelting, wherein an oxygen fuel burner is provided in addition to the main fuel oil burners, and the oxygen content and flow rate of the oxygen-fuel gas mixture is so adjusted that the latent heat due to CO and $H_2$ produced through the combustion in the combustion gas can be utilized at its maximum for increasing the smelting speed and $SO_2$ content.

6 Claims, 5 Drawing Figures

METHOD OF OPERATING COPPER ORE SMELTING REVERBERATORY FURNACE

CROSS REFERENCE TO RELATED APPLICATIONS

This is a continuation-in-part application of our application Ser. No. 445,335, filed Feb. 25, 1974 and now abandoned, which is a continuation-in-part application of our application Ser. No. 264,060, filed June 19, 1972, now abandoned.

This invention relates to operation of a reverberatory furnace for copper smelting wherein copper ore is melted for separation into matte and slag.

Heretofore, a reverberatory furnace for copper ore smelting has been operated in such a way that fuel oil is burnt through one or more burners provided at an end wall of the furnace, and the starting material ore to be smelted is charged from the top of the furnace along the side walls.

In this case, as the burners are provided at one of the furnace end walls, there inevitably occurs non-uniform temperature distribution within the furnace depending on the distance from the burning flame with the result that melting of the starting material copper ore is lacking in uniformity and, depending on the position of the ore within the furnace, the melting speed thereof is retarded to possibly lower the melting efficiency. Moreover, from the structural standpoint, the upper part of the furnace is in the form of a suspended roof which is liable to leave a considerable gap therearound. The furnace operation is carried out under slightly negative pressure so as to prevent gas from being ejected. This negative pressure operation, however, results in introduction of external air into the furnace interior to dilute the concentration of sulphur dioxide gas in the furnace. On account of this dillution, recovery of sulphur dioxide ($SO_2$) from the waste gas is disadvantageously affected from the standpoint of operational economy as well as technology, and hence the gas has usually been discharged into the atmosphere. However, the recent restrictions on air pollution are so stringent that no discharge of waste gas into the atmosphere is permitted. In order, therefore, to obtain complete prevention of air polution, the conventional measures of discharging waste gas into the atmosphere can no longer be maintained, and it has become mandatory to take some effective measures to increase concentration of sulphur dioxide in the waste gas from the furnace operations to completely recover it.

It has also been proposed that oxygen enriched gas be used in the main fuel oil burners to secure perfect combustion of the fuel. In this case, however, the temperature of the burner flame becomes so high that the furnace roof is disadvantageously damaged by the excessive heat.

It is therefore the primary object of the present invention to provide a method for operation of a reverberatory furnace having an improved construction, wherein uniform melting of the starting material copper ore charge within the furnace is attained to broaden passage of the melt bath as far as possible for smooth flow thereof, and, at the same time, to increase the $SO_2$ concentration in the waste gas.

It is another object of the invention to provide a method for operation of a reverberatory furnace having an improved construction, wherein one or more oxygen fuel burners are installed in the furnace roof so as to direct high temperature burning flames from the oxygen fuel burners toward the large stack of the charged starting material copper ore within the furnace to increase the ore melting speed and to increase the $SO_2$ concentration in the waste gas so as to make it economical to completely recover $SO_2$ therefrom, thereby attaining the abovementioned purpose.

The foregoing objects and other objects of the present invention will become apparent from the following detailed description thereof when read in conjunction with the accompanying drawing.

Figure 1:
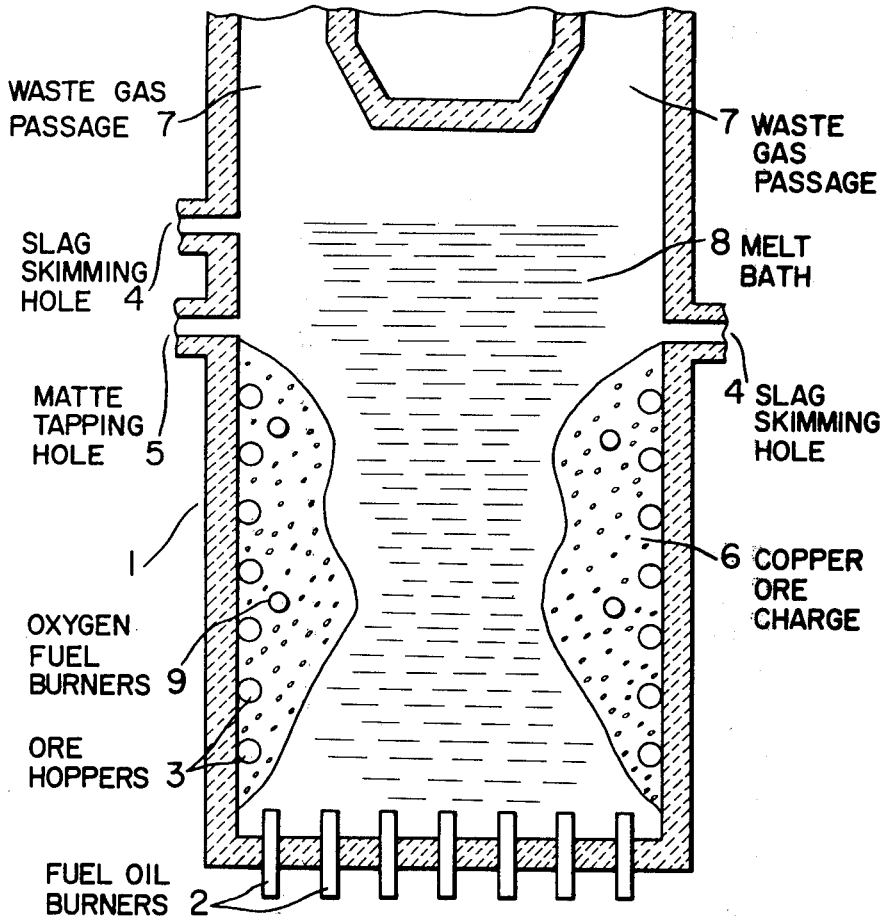
FIG. 1 is a plan view of the reverberatory furnace for copper ore smelting according to the present invention.

Referring now to the drawing, the reverberatory furnace 1 is in a rectangular and flat form, and is constructed with a furnace main body, side walls, end walls, and roof, wherein a plurality of fuel oil burners 2 are provided in parallel at one of the end walls of the furnace. A plurality of hoppers 3 for charging starting material copper ores into the furnace are provided along the long sides of the furnace roof, and feed ores vertically from the top of the furnace in accordance with smelting conditions of the charged ores in the furnace. The starting material copper ores contemplated in the present invention are obtained by subjecting ordinary copper sulfide ores to an ordinary copper-concentrating technique such as flotation; contain sulfur at a concentration of possibly 20 to 35% and ordinarily 25 to 30%; and are in the form of powder, preferably powder having a particle size of under 200 mesh-Tyler.

The feed rate of the starting material copper ore greatly changes according to the size of the reverberatory furnace, but ranges possibly from 20 to 300 tons, usually from 50 to 200 tons per month per square meter of the furnace floor. Copper ores 6 charged into the furnace from the hoppers 3 becomes gradually molten from the surface portion thereof depending on the temperature of the furnace, although, due to non-uniform temperature distribution within the furnace, ores do not melt uniformly but piles of unmelted ores remain in waved or non-uniform shape in the furnace. On the other hand, the molten ore is separated into two layers of matte and slag owing to a difference in the specific gravity therebetween. The matte is tapped out of a matte tapping hole 5 provided on both sides of the furnace in the long side walls of the furnace and at a position opposite the fuel oil burners, and transferred to the subsequent treating process. The slag is skimmed by causing it to overflow from the slag skimming hole 4 provided at one side of the long side walls and at a position above the matte tapping holes, and dumped. Waste gas is sent to the waste gas flues 7 provided in the end wall opposite the fuel oil burners 2 and heat is recovered therefrom in a waste heat boiler (not shown). The bath of molten ore separates into the matte and slag while it is flowing through melt bath 8 in the furnace. at which time irregular piles of unmelted copper ore charge 6 hinder the flow of the melt or change the shape of the melt bath to cause the furnace conditions to deteriorate with the result that it becomes necessary to regulate the quantity of the copper ore charged from the hopper 3.

In order to remove this inconvenience, the present invention proposes that one or more oxygen fuel burners 9 which use oxygen as substantially the sole combustion-supporting material and capable of quickly melting the starting material copper ore be provided which extend downwardly from the roof of the furnace toward the charge 6, and, by burning the oxygen fuel burners 9, the charged ore piles having a slow melting speed are given to as quick a melting speed as that of the other charged piles, whereby the copper ore charge 6 quickly becomes molten, and the ore piles of irregular melting speed can be made uniform.

Figure 5:
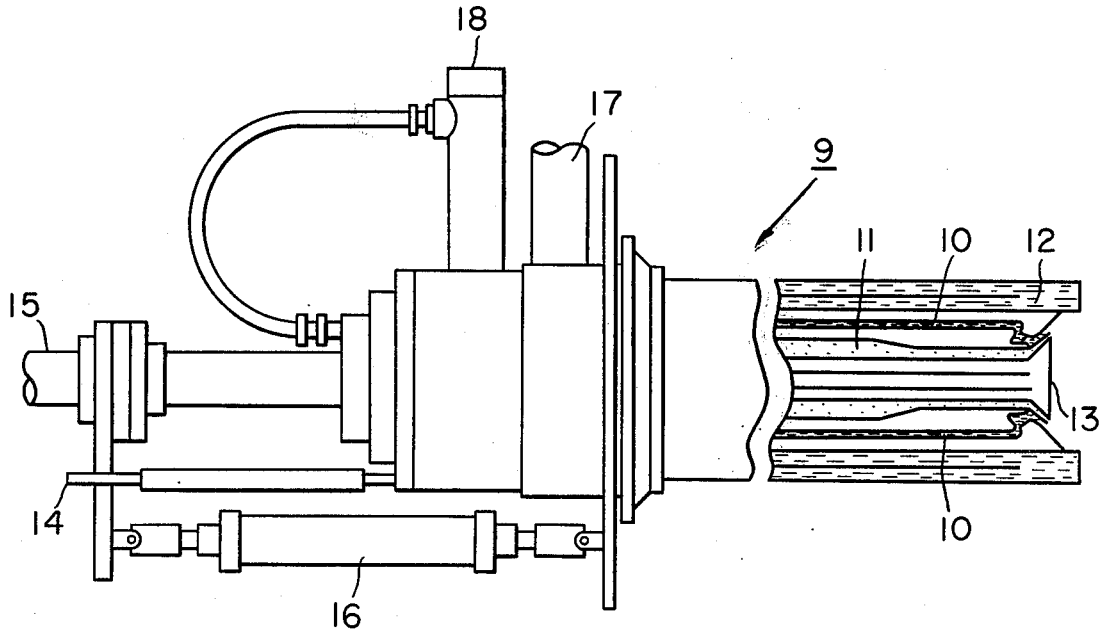
FIG. 5 is a partly exploded view of one embodiment of the oxygen fuel burners used in the present invention.

One embodiment of the oxygen-fuel burners to be used in the present invention is illustrated in FIG. 5, which comprises an annular fuel path 10, an annular oxygen path 11, an annular cooling water jacket 12 a combustion stabilizer 13 which is movably constructed so as to select an optimum gap for oxygen passage, a fuel oil inlet 14, an oxygen inlet 15, a hydraulic pressure actuating cylinder 16, a cooling water inlet 17 and a cooling water outlet 18.

While fuel oil is being burned, the temperature of the flame is dependent upon the partial pressure of oxygen within the combustion-supporting gas. In case of combustion with air, the temperature of the flame is around 1,800° C and it increases as the partial pressure of oxygen increases. But at temperatures above 1,600° C, $CO_2$ and $H_2O$ are subject to thermal dissociation as shown in the following equations (1) and (2).

$$CO_2 \rightleftarrows CO + O_2$$

$$H_2O \rightleftarrows H_2 + O_2$$

Figure 3:
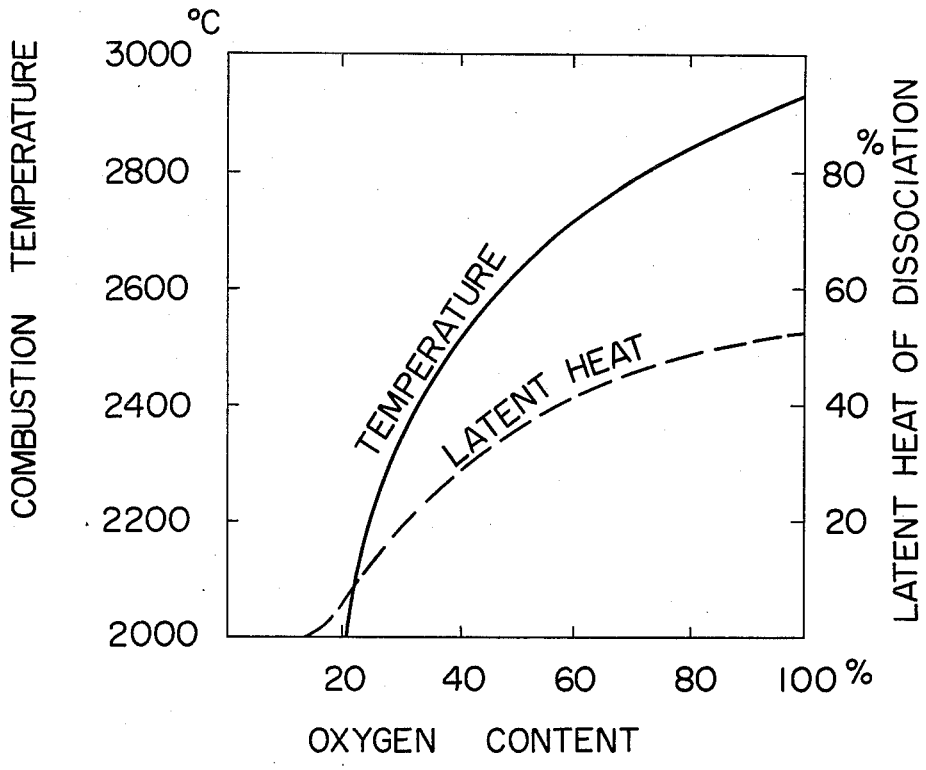
FIG. 3 is a graphical representation of relationships between latent heat of dissociation and combustion temperatures.
Figure 4:
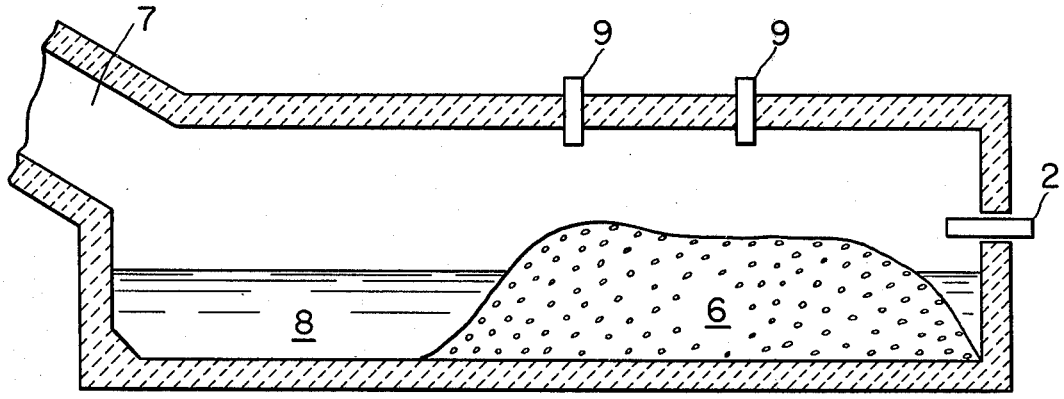
FIG. 4 is a cross section of the furnace shown in FIG. 1 taken along a vertical plane including a pair of oxygen fuel-burners 9 parallel to the side walls.

In other words, the reactions proceed toward the right sides of the equations and therefore complete combustion is not effected, and, as a result, the theoretical maximum temperature of the flame does not exceed 2,900° C approximately. The degree of dissociation of each of $CO_2$ and $H_2O$ varies according as the ambient temperature and the partial pressures of the components vary. For instance, the degree of dissociation of $CO_2$ is 72 to 93% at 2,900° and that of $H_2O$ is 31 to 66% [refer to Netsu-Kanri Benran (Thermal Control Handbook) pp 288–291 published by Maruzen, 1952], and therefore $Co_2$ and $H_2O$ are partially converted to CO and $H_2$ and those products are stored in the combustion gas as a source of latent heat and are not available to supply calories. When the gases which are stored as a source of latent heat, however, are caused to contact the substances to be heated, the temperature drops, and the reactions shown in the equations (1) and (2) move towards the left side and heat is released. The present invention contemplates an improvement of the operation of a reverberatory furnace for smelting copper ore utilizing these characteristics. The relation of latent heat of dissociation to combustion temperature is illustrated in FIG. 3.

Figure 2:
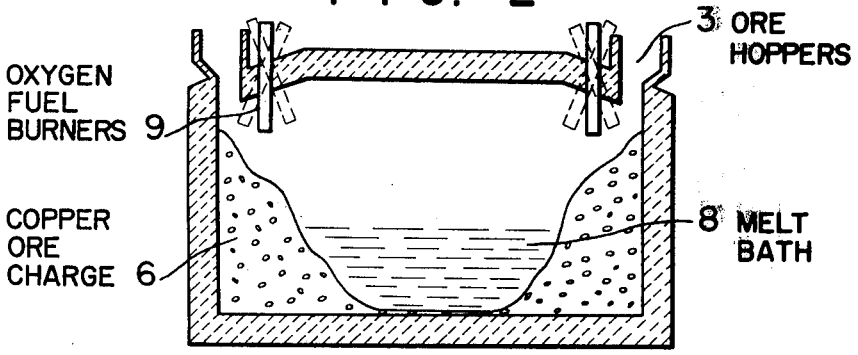
FIG. 2 is a cross section of the furnace shown in FIG. 1.

After an investigation into the possibility of utilizing the latent heat of dissociated gases for smelting the copper ores, it was disclosed that the volume of the exhaust gas produced by the oxygen fuel burner was about one-fifth of the volume of the exhaust gas produced by a conventional fuel oil burner when air was used as the combustion-supporting gas and as a result the flame of combustion could be shortened and that the length of the flame matched the distance between the roof of the furnace and the copper ore charge. As shown in FIG. 2, the copper charge is piled up at an angle of repose in a reverberatory furnace of the set charge type, and the distance between the roof and the upper surface of the charge is about 1 m at a place some 1 m distant from the side wall. Therefore, when an oxygen fuel burner is provided at this place in the roof of the furnace directed downward, the tip of the flame can be made to hit the surface of the copper ore charge by adjusting the angle and length of the insertion of the oxygen-fuel burner and the length of the flame. By so doing, the combustion gas heats the copper ore charge and at the same time the temperature of the combustion gas drops, and as a result the dissociated $H_2$ and CO burn again and generate heat and are subject to a new dissociation equilibrium.

Thus, according to the instant invention the latent heat of the flame can be utilized in addition to the sensible heat and this is one of the most important characteristics of the instant invention.

One may think of enriching the air with oxygen to be used for the main fuel burners, but in that case the temperature of the flame rises up so high that the firebrick of the roof is damaged badly and therefore it is not practicable.

It is also possible to use a conventional fuel oil burner in place of an oxygen fuel burner to blow flame downward, but in this case the temperature of the flame is about 1,800° C and the degrees of dissociation of $CO_2$ and $H_2O$ are 2 to 7% and 0.8 to 2.7%, respectively, and accordingly the utilization of latent heat is almost impossible.

When air enriched with oxygen can be used instead of oxygen in an oxygen fuel burner to blow flame downward, the temperature of the flame can also be raised and the available latent heat can also be increased, but at the same time the volume of exhaust gas will be increased, making the length of the flame longer and the tip of the flame will extend over the surface of the melt bath, and as a result, the dissociation heat cannot be utilized efficiently on the surface of the metal bath where the temperature is very high, and also the surface of the melt bath is oxidized and solidified by the flame which contains oxygen produced by dissociation and as a result the wetting property and fluidity of the melt are decreased and sometimes ores are dispersed by means of the increased flow rate of the gas due to the increased volume of the combustion gas. This method is not appropriate for practical operation either.

It is well known in the art that an oxygen fuel burner is used for melting metallic aluminum or metallic copper, but it is only for the purpose of heating and melting the metals and no chemical reaction with the combustion is effected before and after the melting. In the case of a reverberatory furnace, matte in which most of the copper material is included and slag by which rock-forming content within the starting material copper ore is removed from the system are produced by smelting, and a part, 20 to 30%, ordinarily about 25%, of sulfur within the starting material copper ore burns into $SO_2$ gas and escapes from the system. Since $O_2$ is consumed by the oxidation of sulfur, the partial pressure of oxygen within the combustion gas decreases and becomes insufficient for producing $CO_2$ and $H_2O$ from dissociated CO ad $H_2$. This is the reason why the consumption of $O_2$ by an oxygen fuel burner in a reverberatory furnace for smelting the ores exceeds the theoretical amount. The increase of consumption of oxygen means and increase of the cost of smelting. Optimum conditions should be determined by experiments. According to the result of our experiments, oxygen of about 120% of the theoretical amount was most economical, and oxygen of 100 to 150%, preferably 105 to 130%, of the theoretical amount is used in the present invention. The partial pressure of oxygen within the combustion gas measured at the inlet of waste gas flues 7 is maintained within 0.4 to 0.7% of the total pressure, i.e. about 3 – 5.5 mm Hg-absolute.

These oxygen fuel burners may be inserted into the furnace interior either in the vertical direction or at a slight angle to the vertical. It is of primary importance that the burners be directed against the ore stacks which have a slow melting speed to attain an overall uniform melting condition. As a result of this, there accrue various industrial advantages, for example that the passage for the melt becomes wider, the temperature gradient within the furnace becomes uniform, and the quantity of the copper ores melted increases to a great extent. Furthermore, in view of the character of the oxygen fuel burners 9, the quantity of combustion gas used is extremely small, on account of which the concentration of $SO_2$ in the waste gas can be increased to enable complete recovery of $SO_2$ in the form of sulfuric acid without it being discharged into the atmosphere. This complete recovery of $SO_2$ will contribute greatly to prevention of air pollution due to industrial operations and, at the same time, the furnace conditions become desirable and the automatic feeding of the starting material copper ores can be facilitated. In addition, the $SO_2$ concentration can be further raised, if an adjustment is so made as to substitute a portion of the heat energy of the main fuel oil burners 2 for that of the oxygen fuel burner. In order to effect an economical, complete recovery of $So_2$ in a reverberatory furnace operation, the $SO_2$ concentration in the waste gas is preferably maintained at 2.3% by volume or above.

In practicing the process, the fuel distribution to ordinary fuel burners and oxygen fuel burners can be changed at will based on the economical consideration and within the restriction due to the furnace structure by using an appropriate number of oxygen fuel burners.

Further, the capacity of a reverberatory furnace is usually restricted by the capacity of an accompanying waste heat boiler and sulfur recovery system, and the fuel consumption per certain reverberatory furnace can be greatly increased by the use of oxygen fuel burners, thus resulting in a great increase in the capacity of the furnace since oxygen fuel burners produce only a small volume of combustion gas. However, it is usually reasonable that ordinary fuel burners are made responsible at least for maintaining the furnace temperature (usually from 1200° to 1400° C). For this reason and based on the economical consideration, the fuel consumption in the oxygen fuel burner or burners is preferably limited to about 70% or below, more preferably to this range 5 to 50% of the total consumption in a furnace.

The feed rate of fuel is expected to be greatly reduced by the use of oxygen fuel burners. In fact, the fuel consumption per ton of smelted copper ore was decreased from 187 l/ton to 162 l/ton by the use of two additional oxygen fuel burners in a conventional reverberatory furnace wherein only eight ordinary fuel burners had been used. At that time, the fuel consumption per ton of additionally smelted copper ore for the additional oxygen burners was calculated at 60 l/ton. This means that the use of an increased number of oxygen fuel burners can further decrease the net fuel consumption per smelted copper ore with increased smelting capacity per furnace floor.

In order to enable skilled persons in the art to reduce the present invention to practice, the following preferred embodiments are presented. It should, however, be noted that the invention is not limited to these examples alone, but any change and modification may be made within the spirit and scope of the invention as recited in the appended claims.

EXAMPLE 1

A reverberatory furnace capable of treating copper ores in an amount of 20,000 tons per month using eight fuel oil burners provided at the end wall of the furnace was further provided on its roof with four additional burners using oxygen for combustion of the fuel, as shown in FIGS. 1 and 2.

Copper concentrates were charged from the top of the furnace and subjected to melting. Portions of the ore pile where the melting speed was rather slow were melted using the oxygen fuel burners. As the result of this, concentration of sulfur dioxide in the waste gas increased to 2.9% on the average in contrast to 2.1% on the average when no oxygen fuel burner was utilized, i.e., an increase of 0.8% in the average, and the melting speed of the copper ore became faster with the consequence that an increased quantity of ore treated in an amount of approximately 6,000 tons per month was made possible.

Furthermore, by the increased concentration of sulfur dioxide gas in the waste gas, economical and industrialized mass production of sulfuric acid also became possible.

EXAMPLE 2

In the case reverberatory furnace as used in Example 1 above, two oxygen fuel burners were provided substantially perpendicularly at both sides of the furnace each of which was disposed at a position 1.5 m distant from the long side wall and 7 m from the end wall.

Copper ore was smelted by burning200 l/hr of fuel oil "Grade C" with 500 – 520 $Nm^3$/hr of oxygen, whereupon the amount of copper ore treated was increased by 4,000 tons/month. The concentration of $SO_2$ in the waste gas was 2.5%.

(Note: The fuel oil "Grade C" possesses the following specified properties:

a. ignition point: 70° C and above
b. dynamic viscosity: 50 – 400 cst at 50° C
c. water content: 0.5 – 2.0% by volume
d. ash content: 0.1% by weight and below
e. sulfur content: 1.5 – 3.5% by weight)

EXAMPLE 3

In the same reverberatory furnace as used in Examples 1 and 2 above, a single oxygen fuel burner was provided substantially perpendicularly at a position 6 m distant from the end wall and 2 m from the long side wall. 120 l/hr of fuel oil of Grade C was burnt with 200

$Nm^3$/hr of oxygen, while controlling the flame to spread in an area approximately 3 m in diameter over the ore pile. As a result, the amount of copper ore treatment increased by 2,500 tons/month. The concentration of $SO_2$ in the waste gas was 2.3%.

What is claimed is:

1. In a method of operating a reverberatory furnace for smelting copper containing ores having a relatively large proportion of sulfur therein, the furnace having a main body with long refractory side walls and transverse refractory end walls, the main body containing a melted bath of matte and slag layer overlying the matte, the furnace having a roof covering the main body with a plurality of hoppers opening through the roof along the side walls or closely adjacent thereto for wet charging the starting material copper ore into ore piles along the side walls below the hoppers, one end wall having main burner means therein for directing combustion flames in a substantially horizontal direction over the melt bath, the furnace having an exit for the matte, an exit for the slag and an exit for the waste gas containing sulfur dioxide produced during operation of the furnace, the last mentioned exit being adapted to be coupled to a sulfur dioxide recovery system, the improvement comprising inserting at least one oxygen fuel burner through the roof of the furnace directed downwardly toward the ore piles and feeding a mixture consisting essentially of oxygen and hydrocarbon fuel through said burner with the oxygen being present in the mixture in an amount of from 100 to 150% of the theoretical amount for burning the fuel, said mixture being fed under feed conditions which cause the tip of the combustion flame from said burner just to reach the surface of said ore piles, and maintaining the oxygen partial pressure within said reverberatory furnace measured at said exit for the waste gas within the range of about 3 to 5.5 mm Hg-absolute, whereby latent heat due to CO and $H_2$ produced in the products of combustion in the furnace is utilized so as to increase the rate at which the ore can be smelted, thereby increasing production in the furnace, to reduce the amount of fuel necessary per unit weight of smelted ore, and to increase the concentration of sulfur dioxide in the waste gas so as to make more economical the recovery of the sulfur dioxide.

2. The improvement as claimed in claim 1 in which there is a plurality of oxygen fuel burners inserted through the roof at positions along and adjacent to the side walls of the furnace.

3. The improvement as claimed in claim 1 in which said starting material copper ore is in the form of powder having a particle size under 200 mesh-Tyler.

4. The improvement as claimed in claim 1 in which oxygen is present in an amount of 105 to 130% of the theoretical amount for burning the fuel.

5. The improvement as claimed in claim 1 in which fuel at a rate of 5 to 50% of the total fuel consumption for the reverberatory furnace is burnt by said at least one oxygen fuel burner.

6. The improvement as claimed in claim 1 in which said starting material copper ore is in the form of powder and contains sulfur at a concentration of 20 to 35% by weight, and the $SO_2$ concentration in the waste gas is maintained at 2.3% and above.

* * * * *